US005114666A

United States Patent [19]

Ellingson et al.

[11] Patent Number: 5,114,666

[45] Date of Patent: May 19, 1992

[54] CASK BASKET CONSTRUCTION FOR HEAT-PRODUCING RADIOACTIVE MATERIAL

[75] Inventors: Frederick J. Ellingson, Murrysville; P. Kent Shaver, Valencia, both of Pa.

[73] Assignee: U.S. Tool & Die, Inc., Pittsburgh, Pa.

[21] Appl. No.: 642,184

[22] Filed: Jan. 16, 1991

Related U.S. Application Data

[63] Continuation-in-part of Ser. No. 405,475, Sep. 11, 1989, abandoned.

[51] Int. Cl.[5] ..... G21F 5/00

[52] U.S. Cl. ..... 376/272; 250/507.1

[58] Field of Search ..... 376/272; 250/506.1, 250/507.1

[56] References Cited

U.S. PATENT DOCUMENTS

| | | | |
|---|---|---|---|
| 4,039,842 | 8/1977 | Mollon | 376/272 |
| 4,746,487 | 5/1988 | Wachter | 376/272 |
| 4,770,844 | 9/1988 | Davis, Jr. | 376/272 |
| 4,781,883 | 11/1988 | Daugherty et al. | 376/272 |
| 4,820,472 | 4/1989 | Machado et al. | 376/272 |
| 4,827,139 | 5/1989 | Wells et al. | 250/507.1 |

*Primary Examiner*—Daniel D. Wasil
*Attorney, Agent, or Firm*—Clifford A. Poff

[57] ABSTRACT

A cask basket construction for storing and transporting nuclear waste material, such as spent nuclear fuel assemblies or fuel rods. The construction is comprised of a plurality of individual storage cells for storing the nuclear material, with the plurality of storage cells rigidly affixed to one another to form a high strength, lightweight, unitary array of storage cells. Thermal loading elements positioned between walls of adjacent ones of the cells as well as a coolant flow is provided to transfer heat generated by the nuclear material contained in the storage cells to the outer portions of the cask basket construction. A heat path is included for dissipating the heat transferred away from the center of the array of storage cells. The thermal loading elements further serve as an integral structural component of the array for enhancing the structural strength thereof.

12 Claims, 4 Drawing Sheets

CASK BASKET CONSTRUCTION FOR HEAT-PRODUCING RADIOACTIVE MATERIAL

CROSS-REFERENCE TO RELATED APPLICATION

The present application is a continuation-in-part of U.S. patent application Ser. No. 07/405,475, filed Sep. 11, 1989, now abandoned.

BACKGROUND OF THE INVENTION

1. Field of the Invention

The present invention relates generally to apparatus for the storage and transport of heat-producing material, and, more particularly, to a cask basket construction for storage and transport of radioactive material.

2. Description of the Prior Art

Commercial nuclear facilities generate useful amounts of electrical power by creating heat energy which is converted into electrical power. The heat energy is generated as a by-product of a nuclear fission process which is permitted to occur at a controlled rate. In a commercial nuclear reactor power facility, a nuclear fuel source is positioned in a reactor core area of the facility whereat the controlled nuclear fission process occurs. Coolant water circulates in the reactor core in a heat transfer relationship with the nuclear fuel source, and the heat energy transferred to the coolant water is utilized to heat a secondary water system which, in turn, operates steam generators which produce electrical power.

The nuclear fuel source which fuels the fission process is supported in a supportive structure referred to as a nuclear fuel assembly.

A nuclear fuel assembly is comprised of a plurality of nuclear fuel rods which are hollow metal pipes filled with the nuclear fuel supported by a supportive structure such that the fuel rods are maintained in precisely spaced arrays. In this manner, the nuclear fission process can be controlled and moderated while most efficiently allowing coolant water to circulate in a heat transfer relationship with the fuel rods. Most commercial nuclear power facilities require more than one hundred fuel assemblies to be positioned in the reactor core in order to generate commercially useful amounts of heat to be converted into electrical power.

Over time, the heat generative properties of the nuclear fuel contained in the fuel rods of the fuel assemblies are reduced to an extent necessitating replacement of the "spent" fuel material. During such occasions, the entire fuel assemblies are removed from the reactor core and are replaced with fuel assemblies having fuel rods containing fresh nuclear fuel material. However, the fuel assemblies removed from the reactor core still contain residual amounts of nuclear fuel material which still posses significant heat generative properties.

In order to prevent overheating of the spent fuel assemblies after their removal from the reactor core, the spent nuclear fuel assemblies are immersed in water in storage areas referred to as spent fuel pits. The heat generated by the spent fuel assemblies is dissipated by the water circulating through the spent fuel pit.

As ever-increasing numbers of spent fuel assemblies have been placed in the spent fuel pits, space remaining for the storage of additional spent fuel assemblies has decreased. Because of this limited storage capacity, locations whereat the spent fuel assemblies can be stored for extended periods of time are needed. These long-term storage locations are selected for reasons other than their proximity to the commercial nuclear facilities. Means for transporting the spent fuel assemblies from their storage locations in the spent fuel pits to the locations allowing long-term temporary storage of the spent fuel is required.

When transferring the spent fuel from the spent fuel pits to the remote locations, care must be exercised in order to prevent a temperature rise of the spent nuclear material. Therefore, the means utilized to transport the spent fuel assemblies to their long-term storage locations must provide efficient means for dissipating heat generated by the waste material.

Furthermore, since the cost of fuel (e.g. diesel), required to power freight transport vehicles, like all fossil fuels, continues to upwardly spiral, careful attention should be paid in the design of the cask basket construction so as to maintain the construction not only environmentally safe but also as light in weight as possible. By doing so, the following advantages can be achieved. First, if the weight of the "empty" cask basket construction, per se, is minimized, so too is its filled weight and, therefore, the gross weight of the transport vehicle when the cask basket is loaded thereupon. Hence, less fuel would be expended by the transport vehicle per trip thereof. And second, for a fixed maximum permissible transport weight for either the filled cask basket construction or the transport vehicle, a "minimized" weight cask basket permits the quantity of the nuclear fuel which can be transported to be maximized whereby less trips may be required of the transport vehicle to transport the fuel. Third, minimizing the weight of the cask basket construction serves to render the construction more easily and, generally, more safely handleable.

It is accordingly an object of the present invention to provide a construction for storing radioactive material to allow transport of the nuclear material.

It is a further object of the present invention to provide a cask basket construction which includes a means for transferring heat generated by radioactive material stored in the cask basket construction to prevent overheating of the or the basket material.

It is yet a further object of the present invention to provide a lightweight yet high-strength and environmentally safe spent nuclear fuel cask basket construction.

Still other objects and advantages of the present invention will become apparent in light of the attached drawings and the written description of the invention presented herebelow.

SUMMARY OF THE INVENTION

In accordance with the present invention, a basket construction for storing heat-producing radioactive material to allow transport thereof is disclosed. The basket construction includes a plurality of individual storage cells rigidly secured to one another to form a unitary array of storage cells for storing the radioactive material in selected locations of the storage cells. Preferably, each of the storage cells is comprised of an elongated stainless steel shell having a rectangular cross-section formed of four elongated side walls defining an inner chamber. The dimensions of each storage cell is preferably such as to allow at least one spent nuclear fuel assembly to be positioned within the inner chamber defined by the elongated side walls.

The basket construction further includes means for maintaining adjacent ones of the storage cells of the array at predetermined spacings from one another. In the preferred embodiment in which the storage cells are comprised of elongated side walls, embossed buttons are formed on the elongated side walls such that the embossed buttons formed on facing sidewalls of adjacent cells are aligned with one another and welded theretogether to thereby maintain adjacent storage cells at the predetermined spacings from one another. Slug members may further be positioned between facing embossed buttons of adjacent side walls for facilitating welding of the buttons theretogether and for defining magnitudes of the predetermined spacing between adjacent storage cells. In the preferred embodiment, the predetermined spacings maintained between adjacent ones of the storage cells form passageways extending along the lengths of the storage cells.

The unitary array of storage cells further includes means positioned in the passageways for transferring heat produced by the radioactive material stored in the selected ones of the storage cells and for enhancing the structural strength of the array. In the preferred embodiment in which passageways are formed to extend along the lengths of the storage cells, the means for transferring heat includes thermal loading elements positioned to extend through the passageways in a heat-transfer relationship with the storage cells and the radioactive material contained therein. The thermal loading elements may, for example, be comprised of aluminum sheets or other material having good thermal conductivity characteristics. In the preferred embodiment of the present invention, the means for transferring heat and enhancing the structural strength of the array further include nuclear poison means for absorbing radioactive emissions of the radioactive material stored in adjacent storage cells. The nuclear poison means may, for example, be comprised of boron-containing sheets positioned to extend alongside the aluminum sheets forming the thermal loading elements.

Further in accordance with the preferred embodiment of the present invention, the elongated side walls of the storage cells additionally contain means forming fluid openings extending through the side walls of the storage cells at selected locations therealong. The means forming fluid openings provide convective and conductive passageways between the inner chambers of the storage cells and the passageways formed to extend along the lengths of the storage calls to permit passage of a coolant fluid such as a coolant gas to enter the inner chambers of the storage cells and function in a heat exchange relationship with the radioactive material contained therein. The heated coolant fluid is then allowed to again pass through the fluid openings which provide convective and conductive passageways, and thereafter contact the thermal loading elements positioned in the passageways extending along the lengths of the storage cells to exchange its heat therewith.

The basket construction also includes a means for enclosing the array of storage cells and the radioactive material contained therein. The enclosing means is preferably comprised of a cylindrical shell having lengthwise and diametrical dimensions suitable to allow placement of the unitary array of storage cells therewithin. The cylindrical shell may further include support means for supporting the array of storage cells in position within the cylindrical shell. Additionally, the cylindrical shell may include means engaging with the transferring means for dissipating the heat transferred away from the radioactive material. In one embodiment of the present invention, the support means and the engaging means together form a grid having an internal diameter corresponding to the outer diameter of the array of storage cells.

DESCRIPTION OF THE PREFERRED EMBODIMENTS

Figure 1:
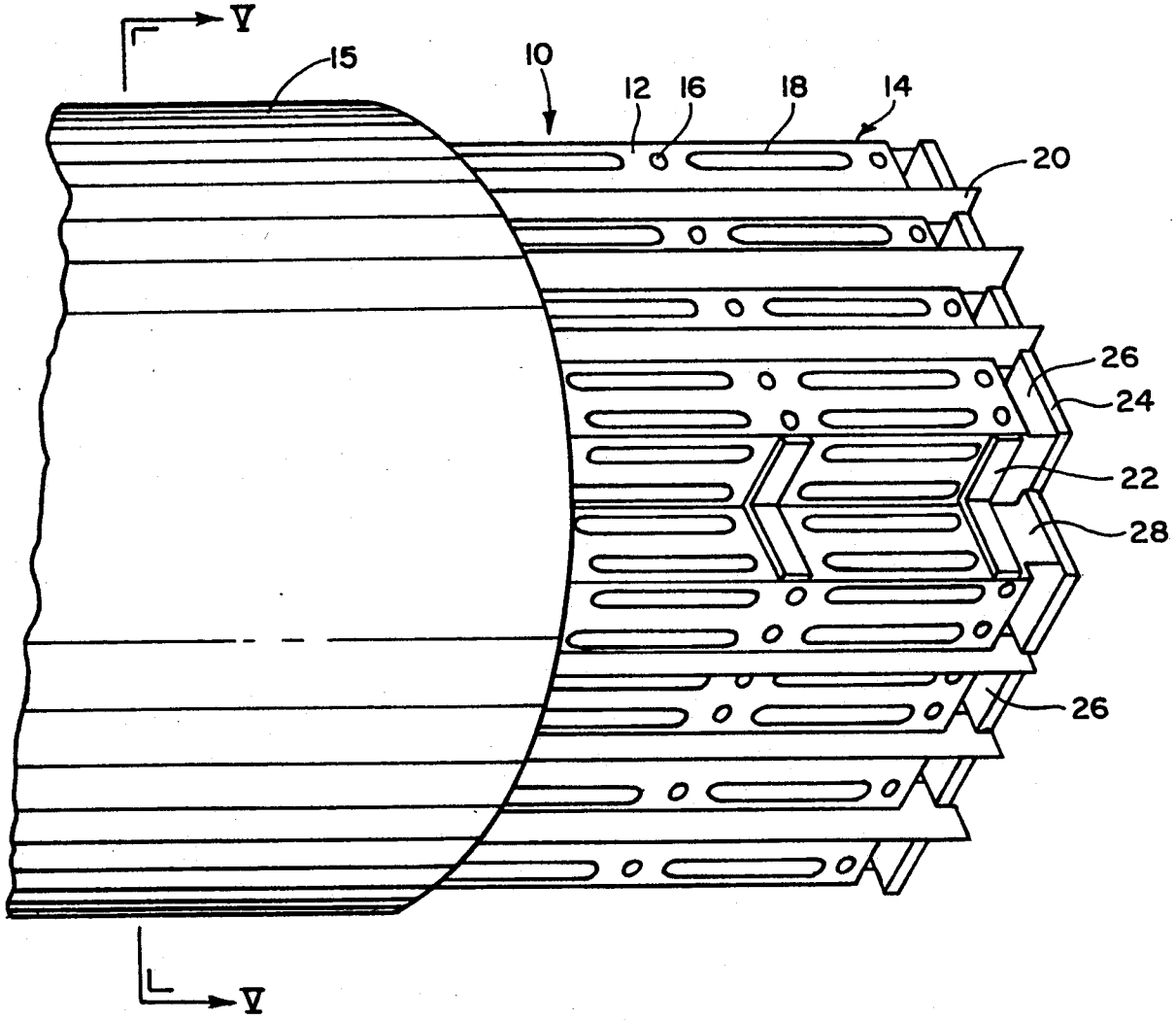
FIG. 1 is a cut-away, schematic view of the basket construction for storing and transporting nuclear material according to the teachings of the present invention.

Referring first to the cut-away, schematic view of FIG. 1, there is shown the cask basket construction for storage and transport of radioactive material, referred to generally by reference numeral 10, constructed in accordance with the teachings of the present invention. The basket construction 10 is comprised of a plurality of individual storage cells 12 connected theretogether to form a unitary array 14 and a cylindrical shell 15 of lengthwise and diametrical dimensions allowing the array 14 of storage cells 12 to be removably inserted therewithin.

In the preferred embodiment of the present invention, as illustrated in the Figures, each storage cell 12 is of a generally rectangular cross section having four elongated side walls for forming an elongated rectangular storage chamber therewithin. It is to be noted, however, that other storage cell geometries may, of course, be alternately used. Furthermore, the storage cells are preferably composed of stainless steel in order to take full advantage of the corrosion resistance and high strength properties of such material. The storage cells forming the array 14 have formed on the elongated side walls thereof a plurality of embossed buttons 16 wherein the embossed buttons 16 formed on facing side walls of the storage cells 12 are aligned with one another. Embossed buttons 16 formed on the side walls of the storage cells 12 maintain a predetermined minimum distance between the facing side walls of the adjacent storage cells 12.

In the preferred embodiment of the present invention, the elongated side walls of each of the storage cells further contain openings 18 along the respective lengths thereof for reducing weight of the storage cells 12, and, as will be described more fully hereinbelow, to form conductive and convective openings to allow the flow of a coolant fluid between the interior chambers formed by the walls of the storage cells 12 and the passageways formed between adjacent storage cells.

Further illustrated in the schematic view of FIG. 1 are corner bracket members 22 positioned to interconnect selected pairs of storage cells 12 for defining the general perimetrical shape of the array. Bracket members 22 are sized as to permit a minimum sliding tolerance between themselves and other corner bracket members, to be described in greater detail hereinbelow, affixed to the interior of shell 15 such that the array 14 may be easily removed from the shell yet positively supported against lateral movement when inserted in the shell. Bracket members 22 may be attached to the side walls of the storage cells 12 by any conventional means. Also illustrated in FIG. 1 is base plate 24 positioned a spaced distance beyond the bottom portion of the array 14 of storage cells 12. The spacing between base plate 24 and the array 14 of storage cells 12 defines transverse a fluid flow channel 26 for each cell.

Figure 2:
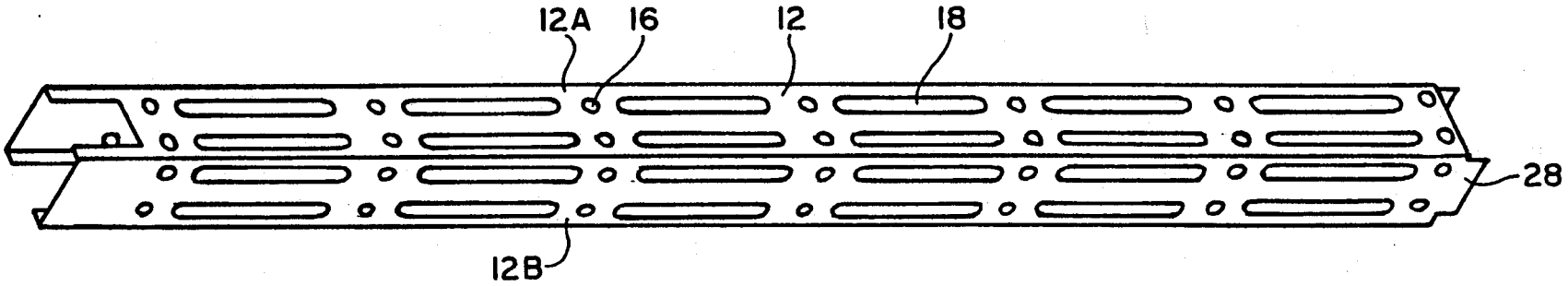
FIG. 2 is a schematic illustration of a single storage cell comprising a portion of the basket construction of the present invention.

Referring now to the schematic illustration of FIG. 2, there is illustrated a single storage cell 12 of the array 14 of storage cells which forms a portion of the cask basket construction of the present invention. As mentioned hereinabove, storage cell 12 preferably is an elongated shell having a rectangular cross section defined by four elongated side walls and each side wall is provided with a plurality of embossed buttons 16 spaced along the lengths of the respective side walls. Also illustrated in FIG. 2 are the openings 18 positioned along the lengths of the elongated side walls. The openings 18 define elongated slots for forming fluid passageways between the interior and exterior of the storage cells and for reducing the weight of storage cells 12. Two opposing side walls of the storage cells contain, either as integral portions thereof or affixed to the end portions thereof, base plate support extensions 28. Extensions 28 allow base plate 24 illustrated in FIG. 1 to be affixed to the array 14 of storage cells 12. Extension 28 further define transverse flow channel 26.

Figure 3:
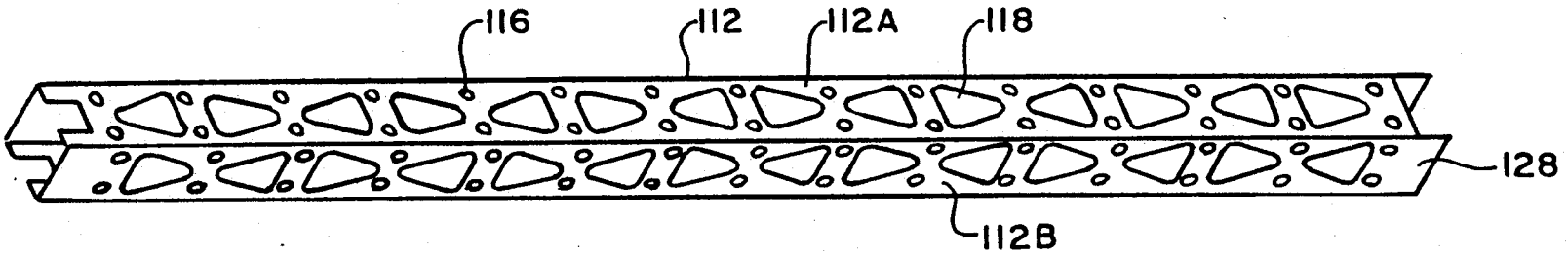
FIG. 3 is a schematic view of a single storage cell similar to the storage cell of FIG. 2 of an alternate embodiment of the present invention.

FIG. 3 illustrates a single storage cell 112 of an alternate embodiment of the present invention. Similar to storage cell 12 illustrated in FIG. 2, storage cell 112 is comprised of an elongated shell having a rectangular cross section defined by four side walls (side walls 112A and 112B are illustrated in the Figure). Each side wall contains a plurality of embossed buttons 116 formed at desired locations along the length thereof. Again, at bottom portions of two opposing side walls are base plate support extensions 128 for engagement and attachment with a base plate. Storage cell 112 of FIG. 3 differs from the storage cell 12 of FIG. 2 only in the dimensions and configurations of openings 118 formed to extend through the respective side walls. Openings 118 are generally triangular, but, similar to the functioning of openings 18 of FIG. 2, serve to form conductive and convective openings to allow the flow of a fluid into and from the interior chamber defined by storage cell 112. Moreover, the triangular shapes of the openings 118 increases the strength of the storage cell 112 by creating in the side walls thereof a continuous truss-like structural configuration.

Figure 4:
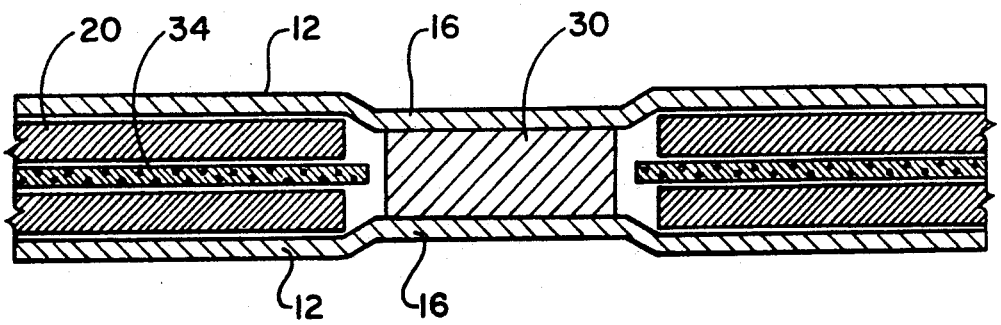
FIG. 4 is a cut-away, sectional view illustrating the connection between facing side walls of adjacent storage cells, a passageway defined therebetween, and a thermal loading element positioned in the passageway.

Turning now to the cutaway, sectional view of FIG. 4, there is shown the connection between two facing side walls of adjacent storage cells 12 of the array 14 of the cask basket construction of the present invention. Illustrated in the preferred embodiment of FIG. 4, positioned between facing embossed buttons 16 formed on the elongated side walls of the storage cells 12 is slug member 30 of suitable composition, e.g. stainless steel, for facilitating welding of the buttons theretogether. The thickness of slug member 30 together with the combined distances at which the embossed buttons 16 are raised above the respective side walls of storage cells 12 defines spacing between the two adjacent storage cells 12. This spacing between adjacent storage cells 12 is illustrated by arrow 32. The spacing between the adjacent storage cells extends along the entire lengths of the adjacent cells 12 to define a passageway thereby. Also illustrated in FIG. 4 are thermal loading elements comprised of aluminum sheets 20 for transferring heat produced by the stored radioactive to the shell 15 of the cask basket construction 10 in a manner to be described hereinafter. Also in accordance with the preferred embodiment, sandwiched between sheets 20 is a sheet of nuclear poison material such as a boral or boron impregnated aluminum sheet 34. Sheet 34 functions to absorb neutrons emitted by the radioactive material storage cells 12 to limit the heat generation of the radioactive material.

Aluminum sheets 20 and boral sheet 34 are notched in order to provide clearance for buttons 16 and slug members 30. Moreover, sheets 20 and 34 are essential for achieving yet another of the primary objects of the present invention. By being enclosed in and virtually filling the passageways between adjacent storage cells, the sheets 20 and 34 define an integral structural component of the array 14, thus enhancing the strength of the array by distributing stresses from cell to cell, by absorbing mechanical vibrations, and by preventing localized buckling of the elongated walls of the cells.

Figure 5:
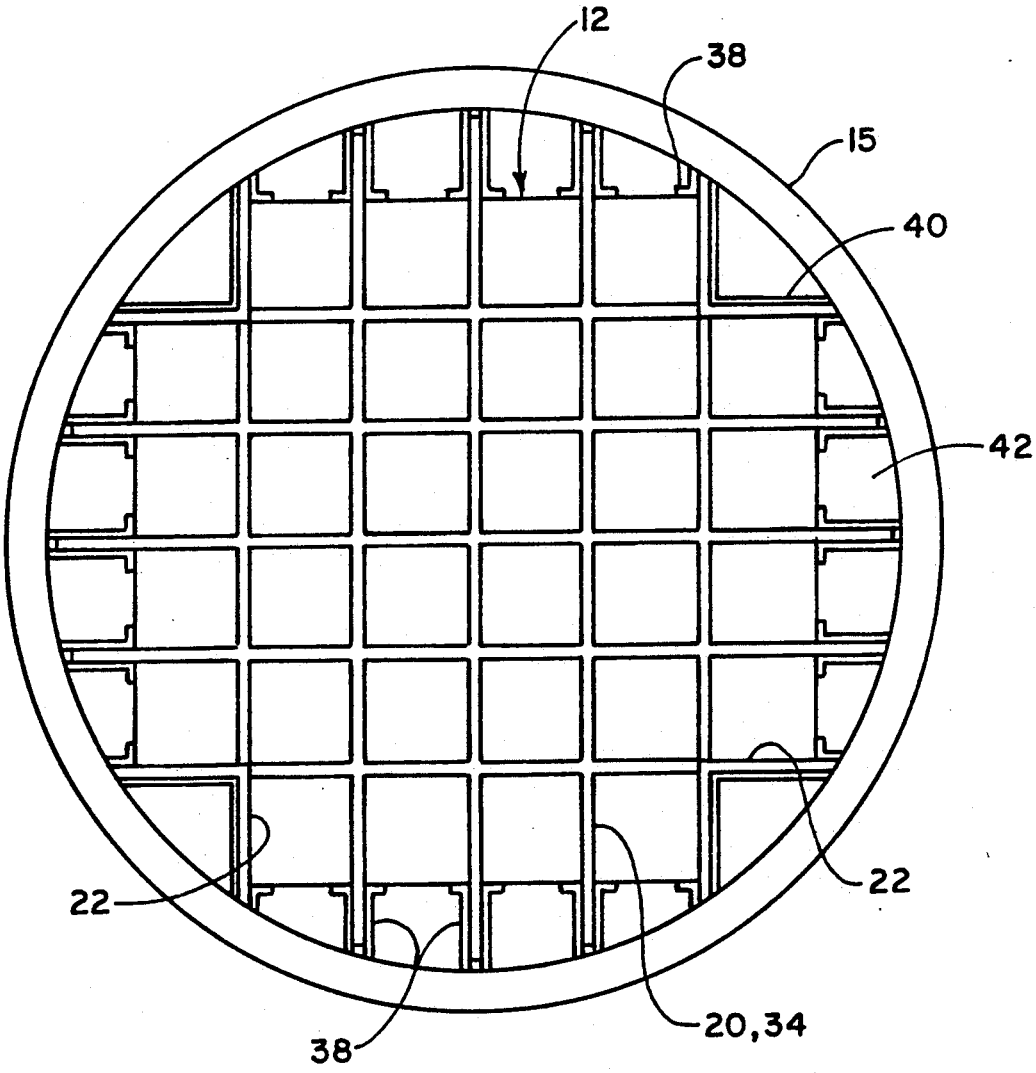
FIG. 5 is a sectional view taken along lines V—V of FIG. 1 illustrating the positioning of the array of storage cells within the cylindrical shell enclosing the array.

Further according to the preferred embodiment of the present invention, the walls of each cell 12 may be from about 8 to 15 feet in length to accommodate various lengths of spent fuel rods and are about 0.093 inches (2.3 mm) in thickness. Each aluminum sheet 20 is approximately 0.190 inches (4.8 mm) in thickness and nuclear position material sheet 34 is about 0.075 inches (1.9 mm) in thickness. So constructed, the total thickness of composite formed by the sandwiched sheets 20 and 34 is approximately 0.455 inches (11.6 mm). Slug members 30 are typically about 0.250 inches(6.4 mm) thick as measured by the spacing between the embossed buttons on opposite sides thereof. As will by appreciated, the above-described sandwiched sheet composite of approximately 0.45 inches thickness, if positioned along at least two and up to four walls of each of the individual cells 12 of the array 14 (as is depicted in FIGS. 1 and 5), contributes materially to the structural strength of the array by providing the aforesaid advantages of stress distribution, vibration absorption and prevention of localized buckling of the cell walls. Regardless of the total thickness of sheets 20 and 34, however, such thickness must be slightly less than spacing 32 in order to compensate for the differential expansion of the stainless steel walls of the cells relative to that of the aluminum sheets 20 and 34.

Turning now to the sectional view of FIG. 5, there is illustrated the relationship between an array 14 of storage cells 12 and cylindrical shell 15. The storage cells 12 are positioned to form the array 14 such that the perimeter defined by the array 14 is of dimensions allowing insertion of the entire array 14 within the cylindrical shell 15. As noted hereinabove, the storage cells 12 of the array 14 are held in position by welding the embossed buttons 16 of facing side walls of adjacent storage cells theretogether, and by use of bracket members 22, which are also illustrated in FIG. 1. Bracket members 38 and corner bracket members 40 are affixed to the inner-diameter of cylindrical shell 15 and are arranged to form a pattern corresponding to the pattern defined by the outer perimeter of the array 14 of the storage cells 12. Gaps 42 separate at least some of the adjacent brackets 38 extending inwardly from the inner diameter of shell is 15. As illustrated, the thermal loading and strength enhancing elements, here sheets 20 and 34, are of lengths to extend beyond the array 14 to act as "cooling fins" allowing engagement with the bracket members 38; while, simultaneously, corner bracket member 40 serve to engage with the bracket members 22 of array 14 in order to provide lateral support for the array when the array is positioned in the shell as well as for guidance of the array during insertion and/or withdrawal thereof from the shell. Bracket members 22, 38 and 40 are comprised of stainless steel, or some other thermally conductive material, so that the aluminum sheets 20 and brackets 38 (and bracket members 22 and 40) are maintained in a heat transfer relationship with one another. Bracket members 38 and 40 thereby function as heat sinks to aid in the transfer of heat away from the center of the array 14 of storage cells 12. Because of their arrangements, brackets 38 and 40 also function as support and damping members for the array.

The basket construction 10 of the present invention is of special utility when heat producing radioactive material, such as spent nuclear fuel rods, must be transported to a remote location. Nuclear fuel rods, either consolidated into compacted form or left in the unconsolidated array of a nuclear fuel assembly, as well as any other radioactive material, are placed in the inner chamber of the storage cells 12 of the array 14. The array 14 may be inserted into the cylindrical shell 15 to be enclosed thereby, either before or after loading with radioactive material.

Heat generated by the material stored in the individual cells 12 is transferred to the sheets 20 and 34 positioned in passageways defined by the spacings 32 separating adjacent storage cells 12. Additionally, the nuclear poison-containing sheets 34 attenuates the radioactive production of the material stored in the individual storage cells 12 by absorbing neutrons emitted by the material stored in the individual storage cells. Because the sheets 20 and 34 are in physical engagement with the brackets 38 affixed to the inner diameter of the cylindrical shell 15, heat transferred to the aluminum sheets 20, in turn, is transferred to the brackets 38. The brackets 38 thereby function as a heat path to dissipate the heat. A similar heat path is also created between bracket members 22 and corner brackets 40.

Figure 6:
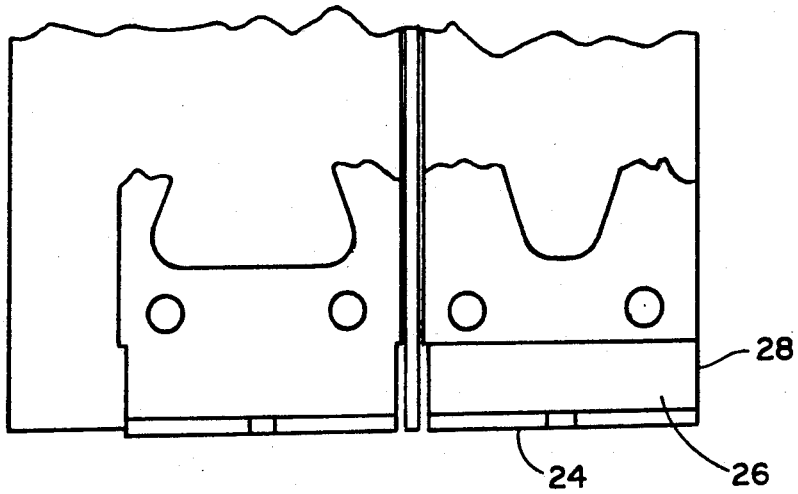
FIG. 6 is an enlarged, cut-away view of a portion of the storage cells of the cask basket construction of the present invention.

The basket construction 10 of the present invention allows a coolant fluid flow, such as a coolant air flow, to aid in the transfer of heat generated by the radioactive material contained in the storage cells 12 away from center of the array 14. Referring now to the cut-away view of the FIG. 6, the bottom portion of a storage cell 12 and its connection with base plate 28 is illustrated. Transverse flow channel 26 defined by the spacing between the storage cell 12 and base plate 24 provides a path to allow the coolant fluid to be supplied to the inner chambers of the storage cells 12. The coolant fluid, either liquid or gas, is thereby provided in a heat exchange relationship to the radioactive material contained in the storage cells 12.

Figure 7:
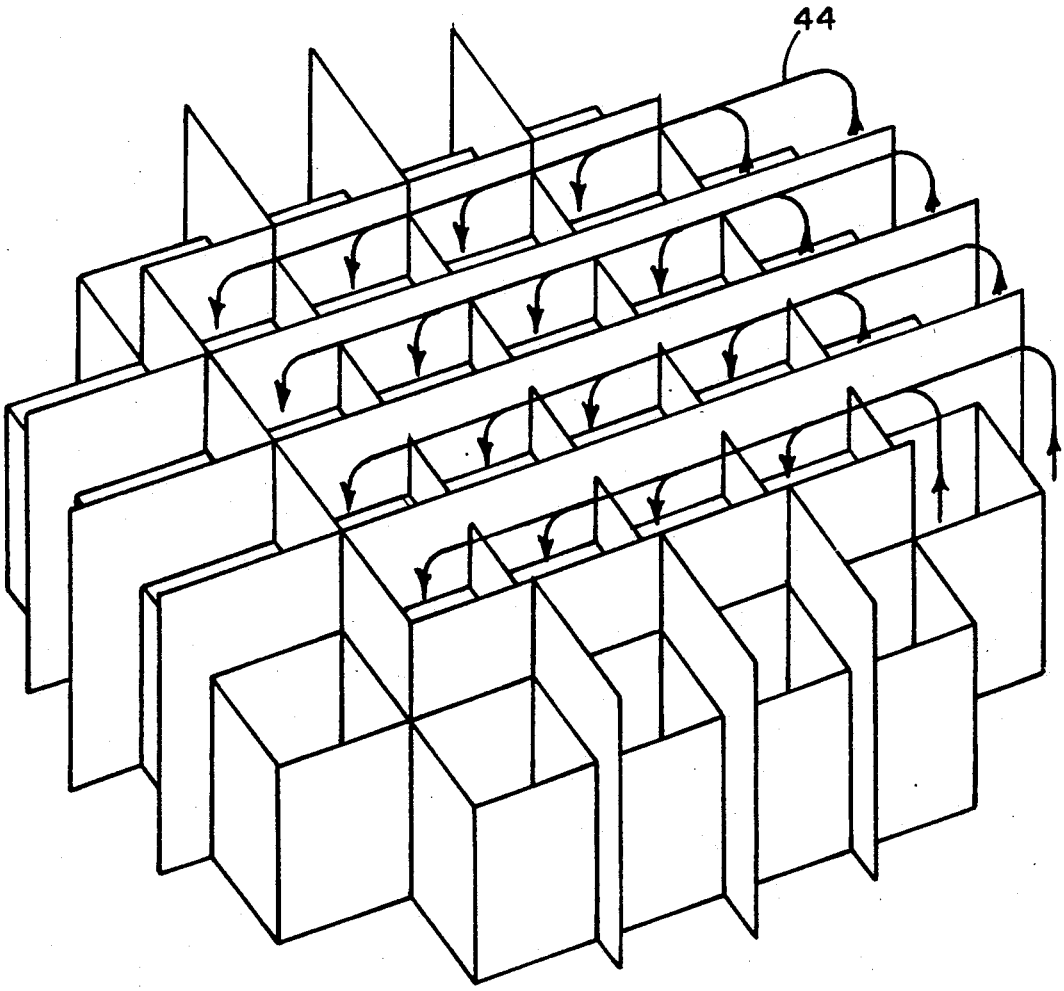
FIG. 7 is a schematic illustration showing the flow of coolant fluid through the array of storage cells to prevent temperature build-up of the radioactive material stored within individual ones of the storage cells.

With reference now to the schematic illustration of FIG. 7, there is shown the path of coolant fluid referenced by arrows 44, which is utilized in the preferred embodiment of the present invention. This fluid flow circulates in a heat transfer relationship with the material stored within the cells 12 to carry the heat generated by the material away from the center of the array 14 to allow dissipation of such heat.

While the present invention has been described in connection with the preferred embodiments of the various figures, it is to be understood that other similar embodiments may be used or modifications and additions may be made to the described embodiments for performing the same function of the present invention without deviating therefrom. Therefore, the present invention should not be limited to any single embodiment, but rather construed in breadth and scope in accordance with the recitation of the appended claims.

What is claimed is:

1. Apparatus for storing heat-producing radioactive material to allow transport thereof, said apparatus including:

a cask basket comprising a plurality of individual storage cells interconnecting one with the another by spacers at spaced apart sites along each cell to form a unitary array of storage cells for supporting said radioactive material in selected ones of said storage cells, said spacers maintaining adjacent ones of said storage cells at predetermined spacings from one another;

a heat dissipating sheets at opposite sides of a nuclear poison sheet to define a total composite thickness of the sandwiched sheets such that the sandwiched sheets fit within said predetermined spacings to thereby become structural component of said array, said heat dissipating sheets transferring heat produced by said radioactive material when stored in a cell away from the storage cells of the array, and means for enclosing said array.

2. The apparatus of claim 1 further including means for dissipating heat transferred away from the storage cells.

3. The apparatus of claim 1 wherein each of said storage cells comprises an elongated shell having elongated side walls defining an inner chamber.

4. The apparatus of claim 3 wherein said spacers includes embossed buttons formed on said elongated side walls of said storage cells wherein embossed buttons formed on facing side walls of adjacent storage cells are aligned with one another and welded theretogether to thereby maintain adjacent storage cells at said predetermined spacings from one another.

5. The apparatus of claim 4 wherein said spacers further includes slug members positioned between facing embossed buttons of adjacent side walls for facilitating welding of said facing buttons theretogether and for defining said predetermined spacings between adjacent storage cells.

6. The apparatus of claim 3 wherein said predetermined spacings maintained between adjacent ones of said storage cells form passageways extending along the lengths of said storage cells.

7. The apparatus of claim 1 wherein said heat dissipating sheets comprise aluminum sheets.

8. The apparatus of claim 7 wherein said nuclear poison sheet includes boron.

9. The apparatus of claim 3 further comprising means for enabling flow of fluid to said inner chambers of said storage cells to thereby dissipate heat away from the inner chamber.

10. The apparatus of claim 2 wherein said means for enclosing includes a shell having dimensions suitable to allow removable placement of said array of storage cells within said shell.

11. The apparatus of claim 10 wherein said means for dissipating include means for supporting said array of storage cells in position in said shell.

12. The apparatus of claim 9 wherein said means for enabling flow of coolant fluid comprise fluid opening means at selected locations along the lengths of the side walls of said storage cells for permitting passage of coolant fluid between said inner chambers of said storage cells and said heat dissipating sheets positioned in said passageways extending along the lengths of said storage cells.

* * * * *